US006799447B2

(12) United States Patent
Mielonen et al.

(10) Patent No.: US 6,799,447 B2
(45) Date of Patent: Oct. 5, 2004

(54) CYLINDER LOCK-KEY-COMBINATION

(75) Inventors: Pekka Mielonen, Reijola (FI); Seppo Kiiski, Joensuu (FI)

(73) Assignee: Abloy Oy, Joensuu (FI)

( * ) Notice: Subject to any disclaimer, the term of this patent is extended or adjusted under 35 U.S.C. 154(b) by 0 days.

(21) Appl. No.: 09/405,436

(22) Filed: Sep. 23, 1999

(65) Prior Publication Data

US 2003/0051521 A1 Mar. 20, 2003

(30) Foreign Application Priority Data

Sep. 25, 1998 (FI) ..... 982066

(51) Int. Cl.[7] ..... E05B 29/04; E05B 19/06
(52) U.S. Cl. ..... 70/366; 70/409
(58) Field of Search ..... 70/365, 366, 376, 70/377, 402, 403, 405–407, 409

(56) References Cited

U.S. PATENT DOCUMENTS

| | | | | | |
|---|---|---|---|---|---|
| 2,217,047 | A | * | 10/1940 | Fitz | 70/366 |
| 2,862,380 | A | * | 12/1958 | Welch | 70/366 |
| 3,789,638 | A | * | 2/1974 | Roberts et al. | 70/366 |
| 3,797,290 | A | * | 3/1974 | Taylor | 70/366 |
| 3,848,442 | A | * | 11/1974 | Mertanen | 70/366 |
| 4,109,495 | A | * | 8/1978 | Roberts | 70/377 X |
| 4,111,021 | A | | 9/1978 | Roberts | 70/406 |
| 4,351,172 | A | * | 9/1982 | Martikainen | 70/402 X |
| 4,375,159 | A | * | 3/1983 | Bechtiger et al. | 70/366 |
| 4,512,166 | A | * | 4/1985 | Dunphy et al. | 70/366 |
| 4,651,546 | A | * | 3/1987 | Evans | 70/366 |
| 5,131,248 | A | | 7/1992 | Ho | 70/366 |
| 5,247,818 | A | | 9/1993 | Lo | 70/493 |
| 5,490,405 | A | | 2/1996 | Rämö et al. | 70/366 |
| 5,613,389 | A | * | 3/1997 | Häuser | 70/366 |
| 5,934,121 | A | * | 8/1999 | Chen | 70/366 X |

FOREIGN PATENT DOCUMENTS

| | | | | |
|---|---|---|---|---|
| AU | 199179625 | | 12/1991 | |
| CA | 1171680 | * | 7/1984 | 70/222 |
| FI | 60284 | | 8/1881 | |
| FI | 25618 | | 10/1952 | |
| FI | 25619 | * | 10/1952 | 70/366 |
| FI | 94452 | | 5/1995 | |
| FR | 2 378 157 | | 8/1978 | |

(List continued on next page.)

*Primary Examiner*—Lloyd A. Gall
(74) *Attorney, Agent, or Firm*—John Smith-Hill; Smith-Hill and Bedell

(57) ABSTRACT

A cylinder lock includes a turnable lock cylinder located inside a lock body and a set of code locking discs located inside the lock cylinder. Each locking disc has a key opening and is turnable in the lock body in a first turning direction from an initial position to an opening position by application of turning force to a counter surface bounding the key opening. The key opening of at least a first code locking disc is bounded by at least two discrete counter surfaces. A key is insertable in the lock when the locking discs are all at the initial position. The key has a set of combination surfaces corresponding respectively to the locking discs, for engaging a counter surface of each locking disc and applying turning force thereto when the key is inserted in the lock and is turned in the first turning direction, so that the locking discs are turned in the first turning direction to their respective opening positions. The combination surface corresponding to the first code locking disc can be provided selectively with one of at least two combination values, whereby the combination surface engages a selected one of the discrete counter surfaces for applying turning force in the first turning direction to the first code locking disc.

32 Claims, 12 Drawing Sheets

FOREIGN PATENT DOCUMENTS

| | | | | |
|---|---|---|---|---|
| GB | 1 367 356 | | 9/1974 | |
| GB | 2 136 869 | | 9/1984 | |
| GB | 2210660 | * | 6/1989 | ..... 70/366 |
| GB | 2 266 119 | | 10/1993 | |
| HU | 208 720 | | 12/1993 | |
| HU | 208 721 | | 12/1993 | |
| JP | 7180406 | | 7/1995 | |
| SE | 115282 | * | 10/1945 | ..... 70/366 |
| SE | 184144 | * | 6/1963 | ..... 70/366 |
| WO | WO 99/09280 | | 2/1999 | |

* cited by examiner

CYLINDER LOCK-KEY-COMBINATION

BACKGROUND OF THE INVENTION

The invention relates to a cylinder lock-key-combination, a key blank intended for the combination and a key intended for the combination and made from the key blank.

In growing markets great numbers of opening combinations for selected lock mechanisms and/or additional new key profiles are needed for large groups of locks to be masterkeyed, which can be distinguished from earlier key profiles already provided for the markets and which can be utilized for keeping the different lock groups separate from each other. A key profile refers here to the form of a key before any combination surfaces or combination cuts required by the actual opening combination of the lock are made. For big applications it may even be necessary to provide dedicated key profiles. In addition depending on the application different key profiles should be available on the one hand for locks operated in only one turning direction and on the other hand correspondingly also for bidirectionally operable locks. The turning direction or operating direction of a lock refers here to the direction in which the key turns for opening the lock mechanism. Since cylinder locks provided with so-called rotatable locking discs are advantageous from the viewpoint of their masterkeying and pick-proof properties, the new key profiles should be suitable for particular lock mechanisms of this kind.

A bidirectionally operable cylinder lock provided with rotatable locking discs and having a symmetrical key which may be inserted in the lock in two different turning positions is known from U.S. Pat. No. 4,351,172. This lock can be adapted also to be operable in only one turning direction, but this requires positively blocking one of the turning directions by means of a separate blocking member. A more recent cylinder lock is known from U.S. Pat. No. 5,490,405. This lock is operable in only one turning direction and the returning of the locking discs is accomplished by making use of a separate returning member, whereby more space is obtained in the shank of the key for different profile grooves. In this lock the opening for the key in the locking discs is additionally designed in a certain way so that for example a key according to a practical implementation of U.S. Pat. No. 4,351,172 is not operable in the lock shown in U.S. Pat. No. 5,490,405. Hereby, by means of this solution a key profile family of its own is provided which is independent of earlier key profiles.

Also the patent FI 25618 shows a bidirectionally operable lock in which the selection of the direction of operation occurs by means of a separate guiding plate located in front of the set of discs. In this solution, in the key opening of the locking disc there is a counter surface for each possible combination cut. In addition the key itself comprises a key shank having a separate bit part for combination cuts, which is in clear contrast to the keys according to the solutions mentioned above. Thus the key inserted in the lock is available for only one turning direction at a time and in addition the opening combination is identical for both turning directions.

An aim of the invention is to provide a novel cylinder lock-key-combination, new keys intended therefor as well as key blanks for the keys, suitable particularly for locks provided with rotatable locking discs and making it possible to provide new key profiles which are operationally independent of prior known key profiles. An aim is additionally to provide a solution offering versatile possibilities for adapting the invention in view of different needs for locking so that it may easily be adapted to locks operable on the one hand in one turning direction and on the other hand in two turning directions. In addition the solution should be uncomplicated, secure as to its operation and advantageous as to its costs.

SUMMARY OF THE INVENTION

In accordance with the invention the key opening of at least one locking disc has at least two discrete counter surfaces for effecting turning of the locking disc in one direction, and these counter surfaces are so dimensioned and arranged with regard to each other that at least two different combination values can be alternatively selected for the corresponding combination surface of the key. Different combination values refer to the possible different turning angles through which the key turns the locking discs in order to open the lock mechanism. In accordance with the invention a simple and well-defined design is obtained for the key opening of the locking disc which may effectively be utilized in cooperation with the combination surfaces of the key having a key profile of clearly different design from those previously known. In addition the same basic solution may with advantage be adapted both for cylinder locks operable in one direction and for cylinder locks operable in two directions.

The technical effect of the solution can further be improved when the key opening of a code locking disc which can be provided with different combination values has two counter surfaces for one turning direction of the key, and the two counter surfaces are angularly spaced from each other about the turning axis of the locking disc and are disposed at different respective angles to the central axis of the key opening of the locking disc so that they are inclined at an angle of about 30°. The central axis of the key opening extends in the plane of the locking disc as distinct from the turning axis of the locking disc, which is perpendicular to the central axis of the key opening and passes through the center of the key opening.

When the counter surface in the key opening of the code locking disc corresponding to larger turning angles of the key extends substantially to the central normal of the central axis of the key opening, the key opening may in a simple way be made fully symmetrical for a bidirectionally operable lock or partly symmetrical for a unidirectionally operating lock. In both cases the counter surfaces and/or return surfaces for the same turning direction are diametrically located with regard to the turning axis of the locking disc.

The key openings of the code locking discs can with advantage be at least substantially identical and formed so that some degree of free turning of the key is provided, i.e. the code locking discs turn with the key only after the key has been turned to some degree, for instance about 15°, from the initial insertion position of the key. The lock includes further at least one lifting 0-locking disc of which the key opening is smaller than the key opening of the normal code locking discs and which always turns when the key is turned in the lock. The basic aim of a lifting 0-locking disc is to provide for returning of the locking bar into its locked position under positive guidance when the lock mechanism is locked. No code locking disc has in this case the 0. combination. Consequently, the combination values of the code locking discs determining the opening combination of the lock are totally independent of the 0-locking disc and its counter surfaces, which increases the number of opening combinations available and improves the masterkeying properties of the solution according to the invention. In addition the lifting 0-locking disc may naturally be utilized for defining the profile of the key shank compatible with the key channel and to arrange for desired variations thereof for providing different lock families.

When the lock is operable in only one turning direction, the surface of the key opening of a code locking disc opposite to the counter surface with regard to the central axis serves as a return surface, which in cooperation with the key is used to return the locking discs to the locking position of the lock mechanism. By arranging the return surface in the same plane as one of the counter surfaces of the locking disc a simple and well-defined form is obtained for the key opening. The solution is secure as to its operation and no separate return members are needed in it.

When the lock is operable in both turning directions the code locking disc has in total four counter surfaces for each turning direction, the counter surfaces serving for the same turning direction being located in pairs diametrically on either side of the turning axis of the locking disc.

The basic form of the shank of a key blank according to the invention in the perpendicular cross-sectional plane of the shank, exclusive of any possible profile grooves or corresponding grooves extending over the shank, is substantially rectangular except for at least one bevel surface at one or more corners for providing at least one combination surface. Hereby the basic form of the shank of the key blank is simple and advantageous to manufacture.

Advantageously the bevel surface provides selectively one of two combination surfaces having different respective combination values. In this way the number of different combination values normally to be utilized in this lock type can easily be obtained without compromising the security of operation for opening the lock. The length of the individual combination surfaces may be shorter than in a conventional lock. On the other hand the solution makes it also possible to increase the number of combination values, which provides for multiplying the opening combinations available.

In practice the bevel surface forms in the perpendicular cross-sectional plane of the shank of the blank an angle of 20°–30°, preferably an angle of about 25°, with the central axis extending in the direction of the longer side of the rectangular cross section of the shank. The bevel surface may be divided into two parts which extend mutually in different directions and each of which forms one combination surface. Alternatively the bevel surface may be divided into two at least substantially parallel parts separated from each other by a step or the like and each forming one combination surface. Hereby manufacturing of illicit keys may be made more difficult. In addition hereby an entirely new family of key profiles can be provided.

By arranging the shank of the key blank to be symmetrical as to the parts located diametrically opposite each other with regard to the central axis of the shank so that there is a bevel surface at each of two diametrically opposite corners, the key can be inserted in the lock in two different turning positions. In the case of a lock operable in both turning directions each corner of the shank of the key blank may be provided with a bevel surface so that the shank of the key blank is symmetrical with regard to both the central axis parallel to the perpendicular cross-sectional plane of the shank and its central normal. When on the other hand the key blank is intended for a lock operable only in one turning direction the bevel surface at every second corner of the shank may operate as a return surface for the locking discs.

The invention relates also to a key for a combination defined above and to be made from a key blank defined above, which is characterized in that the basic form of the shank of the key blank in the perpendicular cross-sectional plane of the shank, exclusive of any possible profile grooves or corresponding grooves extending over the shank of the key, is substantially rectangular except for at least one bevel surface at one or more corners and providing combination surfaces corresponding to the code locking discs of the lock. The bevel surface provides at least one selectable combination surface, and the value of other successive combination surfaces in the key is determined on the basis of the combination of the angle of cutting and the length of the cut surface of the cuts to be made in the bevel surface.

The bevel surface may with advantage comprise two combination surfaces having different combination values. In this case the angular pitch between cuts corresponding to successive combination values may respectively be about 15°, which is sufficient to secure reliable operation of the lock and makes it possible to utilize a 0-cut only for the lifting 0-locking disc independent of the combination values to be given for the code locking discs.

In a favorable embodiment of the key the length of the cut surfaces corresponding to different combination values is determined so that the extreme or outer ends thereof are located at most on three different peripheral surfaces measured from the central axis of the shank of the key. A peripheral surface means here not only an arc of a circle or other curved surface but also a plane or possibly a surface including even several separate plane parts. Correspondingly the extreme ends of the cut surfaces providing for turning movement for the locking discs and corresponding to different combination values are with advantage located on two different peripheral surfaces measured from the central axis of the shank of the key. In this case the combination surfaces extending to the same peripheral surface are with advantage located mutually with equal pitch, which makes manufacturing of the key simpler. However, the mutual angular pitch between successive combination surfaces located on different peripheral surfaces need not be in accordance with the pitch in question, but it is sufficient that the mutual pitch between the counter surfaces in the code locking disc is selected to operationally correspond to said angular pitch between successive combination surfaces located on different peripheral surfaces, so that the turning movement imparted to a code locking disc by means of the key is operationally compatible with the location of the peripheral notch of the code locking disc.

The parts of the combination cuts diametrically opposite each other with regard to the central axis of the shank of the key are with advantage located symmetrically, whereby the key can be inserted in the lock in two turning positions. In addition in the case of a bidirectionally operable lock the key includes four cut surfaces for each code locking disc so that the combination cuts located diametrically opposite each other with regard to the central axis of the shank of the key are identical.

BRIEF DESCRIPTION OF THE DRAWINGS

In the following the invention is described, by way of example only, with reference to the attached drawings, in which.

DETAILED DESCRIPTION

Figure 1:
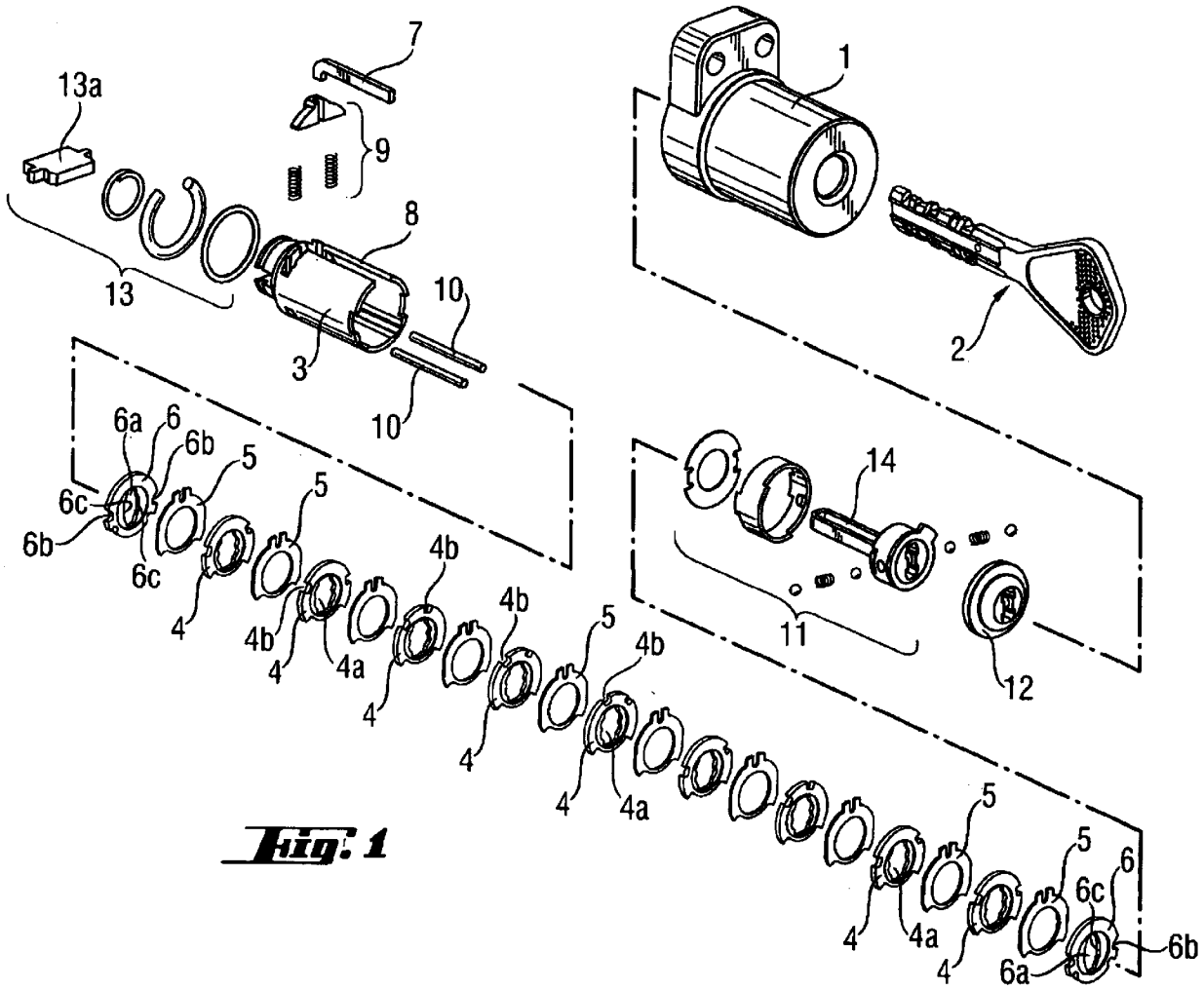
FIG. 1 shows a bidirectionally operable embodiment of the solution according to the invention as an exploded view.

In the drawings 1 indicates a lock body enclosing a lock cylinder 3 turnable by means of a key 2 of the lock. With reference especially to FIG. 1 showing a bidirectionally operable lock mechanism in accordance with the invention, the lock cylinder 3 encloses a set of code locking discs 4, which determine the opening combination of the lock and which are separated from each other by means of intermediate discs 5, which are non-turnably supported to the lock cylinder 3. In addition at each end of the set of discs 4 and 5 there is a so called lifting 0-locking disc 6, which turns continuously with the key when the key is turned in the lock. From the viewpoint of operation it is not necessary that the 0-locking disc nearer the key insertion end of the set of discs (the outer 0-locking disc) be located right at the first or key insertion end of the set of discs, although this is often the case in practice. The locking discs 4 and 6 have key openings 4*a* and 6*a* respectively, which provide counter surfaces for the key, and peripheral notches 4*b* and 6*b* for either turning direction. The key openings 4*a* of the code locking discs 4 are identical, and the combination value of a particular code locking disc with respect to one of its two turning directions depends on the angular position of the peripheral notch 4*b* for that turning direction relative to the key opening 4*a*.

The lock mechanism includes additionally a locking bar 7, for which the lock cylinder 3 has a slot 8 and the inner surface of the lock body 1 has correspondingly a groove 16 (cf. FIGS. 7, 8, 9 and 10). In the locking position of the lock mechanism the locking bar 7 is located, pressed by the locking discs 4 and 6, partly in the slot 8 and partly in the groove in the lock body thereby preventing turning of the lock cylinder 3 relative to the lock body 1. Springs 9 guide the movement of the locking bar 7 relative to the lock body 1 and the lock cylinder 3 making the operation of the lock mechanism smoother.

Return bars 10 are utilized for returning the code locking discs 4 to their locking position after opening of the lock mechanism. A rotation limiting means or disc controller 11 allows the key 2 of the lock to be inserted in the lock and removed from the lock only in a certain turning position. At the same time the disc controller prevents turning of the key in the lock until the key is fully inserted in the lock, which helps to provide an undisturbed operation of the lock mechanism. The disc controller 11 may also be utilized for defining the key profile, whereby for this purpose it can replace the outer 0-locking disc 6. Thus the disc controller 11 is useful from the view point of the operation of the lock, but from the view point of applying the invention, however, it is not necessary. A drilling shield 12 protects the set of discs of the lock and when desired it may also be utilized for defining a suitable key profile for the lock.

Mounting elements 13 keep the lock cylinder 3 installed in its place in the lock body 1. After the lock mechanism is opened or released and the key is turned further in the lock body, force is transmitted from the key through a torque plate 13*a* to a suitable member, for instance a lock bolt (not shown). The lock is also provided with a guiding element 14 located in a key channel formed jointly by the key openings of the discs. The guiding element 14 is supported to the 0locking disc 6 and to the disc controller 11 so that when the key is turned in the lock, the guiding element 14 turns continuously as well. The guiding element 14 guides insertion of the key into the lock and removal from the lock. It serves also as a protection against picking of the lock. In addition it affects the profile of the key compatible with the lock (cf. FIG. 3). The basic operation of all these members is known as such and will partly be discussed further below.

Figure 2A:
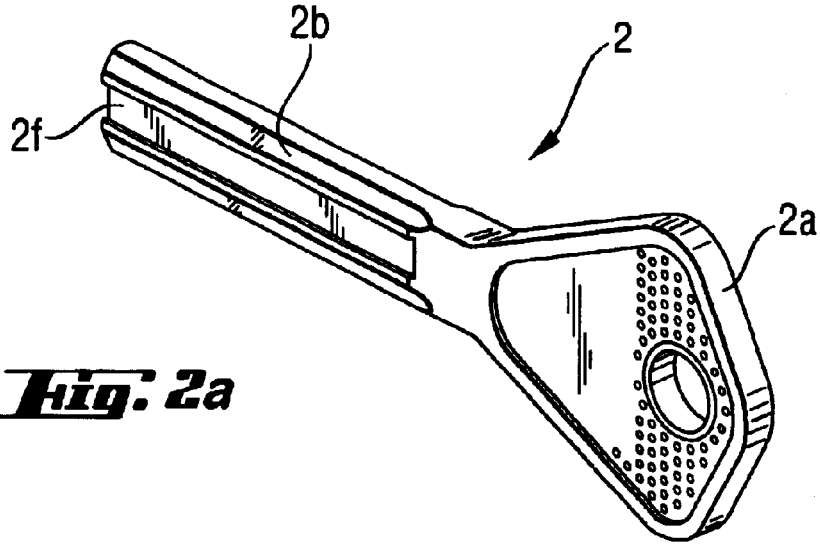
FIG. 2*a* shows a key blank suitable for the embodiment of FIG. 1
Figure 2B:
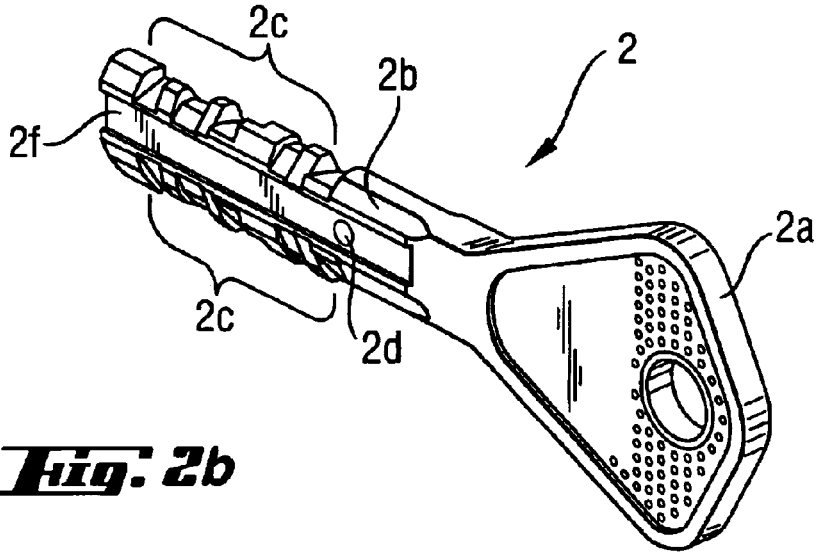
FIG. 2*b* shows a key cut from it.

FIG. 2*a* shows a key blank 2 for a lock according to FIG. 1 including a key bow 2*a* and a key shank 2*b*. FIG. 2*b* shows correspondingly a key 2 made from the key blank 2 of FIG. 2*a* and including a shank 2*b* and a bit formed with combination surfaces 2*c* for all the locking discs 4 and 6 in the set of discs. The key of FIG. 2*b* includes totally four series of combination surfaces for each locking disc, whereby there are two series for each turning direction so that the key may be inserted in the lock in two different turning positions differing from each other by 180°. In addition the key includes grooves 2*f* for the guiding element 14 and recesses 2*d* for balls or corresponding blocking members included in the disc controller 11. The operation of these balls is based on the fact that when the key is inserted in the lock they are pressed against respective springs allowing hereby insertion of the key into the lock. However, as soon as the key is turned, guiding surfaces arranged in the disc controller 11 press the balls towards the key channel so as to be located partly in the recesses 2*d* thereby preventing removal of the key from the lock.

In accordance with the basic operation of the lock mechanism of FIG. 1 when the mechanism is to be opened or released the locking discs 4 and 6 are turned by means of the key 2 of the lock, whereby each locking disc turns as is determined by the combination surface made in the key for the locking disc in question so that the peripheral notch 4*b* or 6*b* respectively is located at the position of the slot 8 of the lock cylinder 3 and the locking bar 7. Thus, a uniform channel is formed of the peripheral notches 4*b* and 6*b* into which the locking bar 7 moves thereby releasing the lock cylinder 3 to be turnable relative to the lock body 1.

Figure 10A:
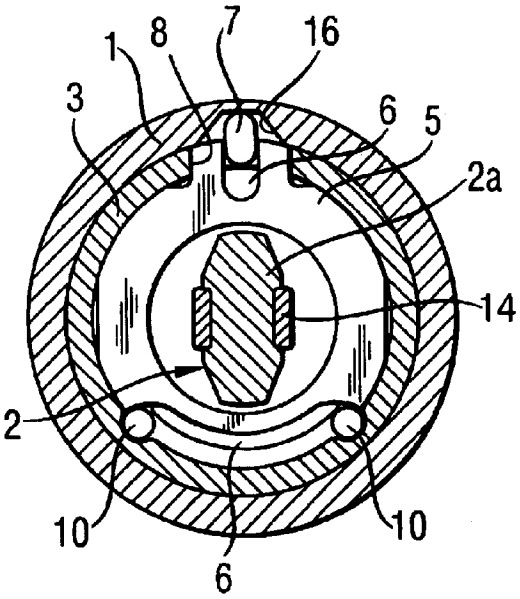
FIGS. 10*a*, 10*b* and 10*c* illustrate the operation of the embodiment of FIG. 1 in a cross-sectional plane of the lock cylinder taken at the position of an intermediate disc and in different turning positions of the key.
Figure 9A:
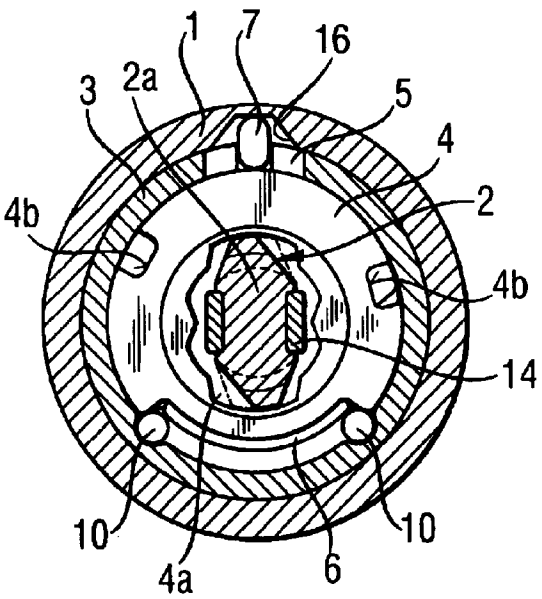
FIGS. 9*a*, 9*b* and 9*c* illustrate the operation of the embodiment of FIG. 1 in a cross-sectional plane of the lock cylinder taken at the position of a code locking disc and in different turning positions of the key.
Figure 8A:
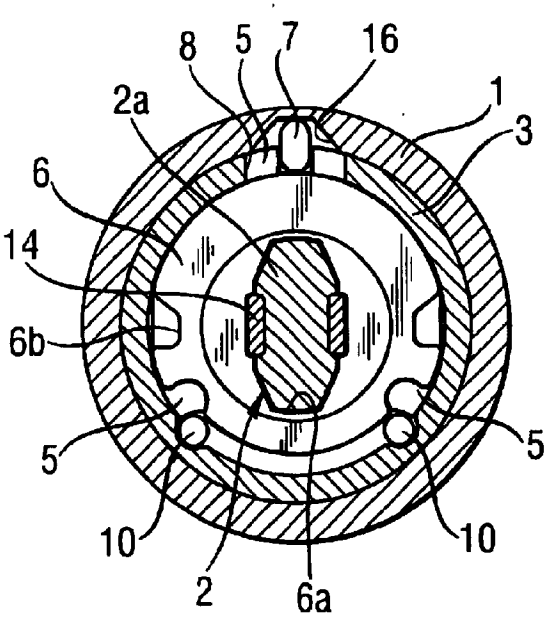
FIGS. 8*a*, 8*b* and 8*c* illustrate the operation of the embodiment of FIG. 1 in a cross-sectional plane of the lock cylinder taken at the position of a lifting 0-locking disc and in different turning positions of the key.
Figure 10B:
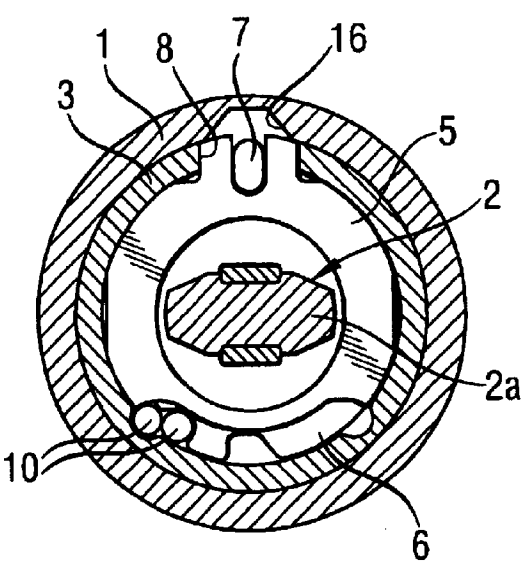
Figure 9B:
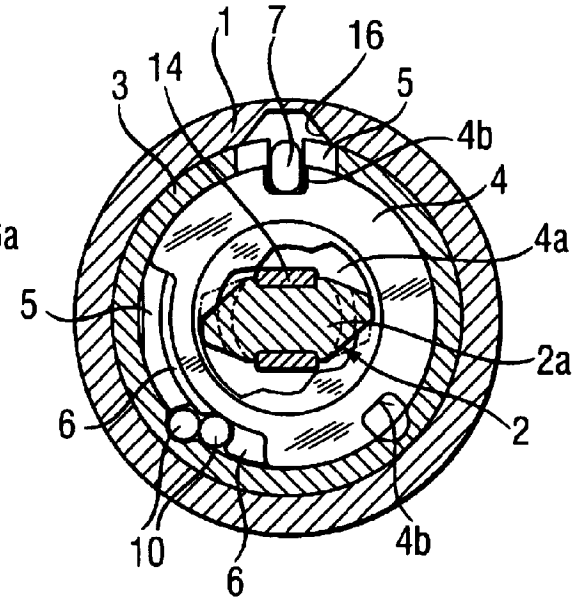
Figure 8B:
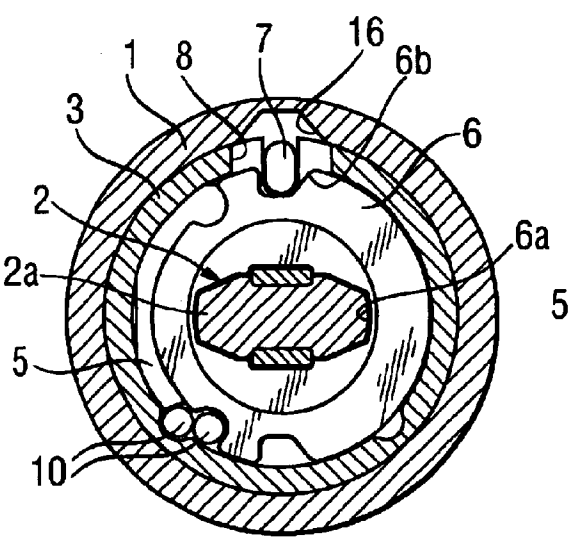
Figure 10C:
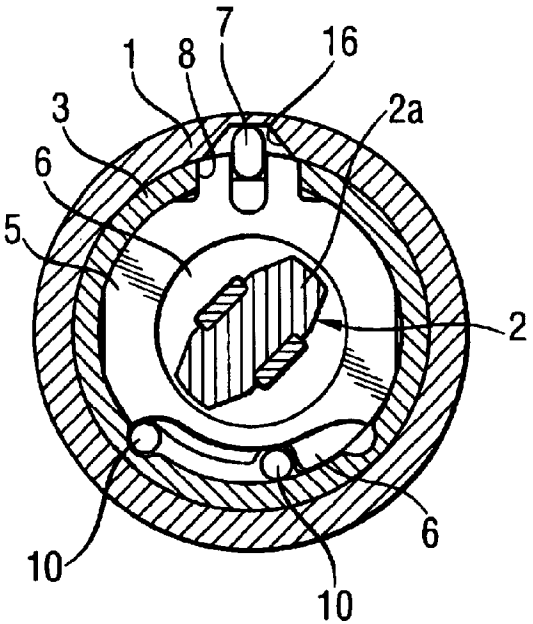
Figure 9C:
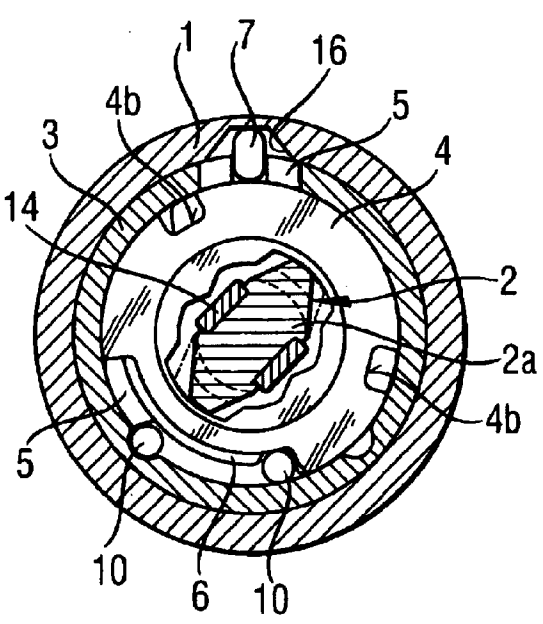
Figure 8C:
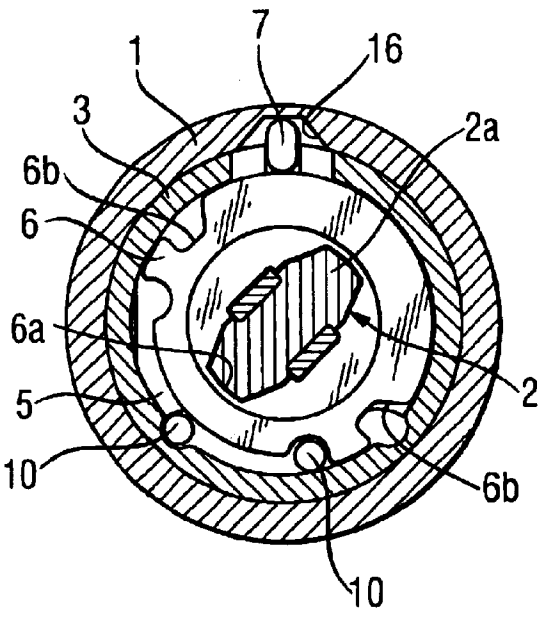

Since the lock mechanism shown in FIG. 1 is bidirectionally operable, it can be opened by turning the key from the initial (insertion) position in either direction, and so the opening combination and thus the location of the peripheral notches can be different for the two turning directions. In addition locking of the lock mechanism and thus returning of the code locking discs 4 to their locking position, which enables removal of the key from the lock, cannot occur directly by force transmission from the key to the locking disc 4 in the case of a bidirectionally operable lock mechanism. Hence the returning is arranged as a force transmission from the key to the 0-locking disc, the peripheral guiding surfaces of which together with the inner surface of the lock cylinder 3 guide each return bar 10 at a time to return the code locking discs 4 to their respective initial positions. The operation of the mechanism appears more closely from FIGS. 8, 9 and 10, which show the location of different parts of the lock mechanism and the return bars 10 and the guidance provided at the position of the 0-locking disc, the code locking disc and the intermediate disc in different turning positions of the key. FIGS. 8*a*, 9*a* and 10*a* correspond to the initial position of the key being inserted in the lock, FIGS. 8*b*, 9*b* and 10*b* correspond to a position in which the key has been turned about 90° clockwise to the opening or releasing position of the lock mechanism, and FIGS. 8*c*, 9*c* and 10*c* correspond to a position in which the key has been turned half-way back towards the initial position, whereby the locking bar 7 is moved into its locking position and one of the return bars 10, urged by the key and the 0-locking disc, moves the code locking discs 4 back to their initial positions locking the lock mechanism. The operation of the mechanism is more closely described also in U.S. Pat. No. 4,351,172, the disclosure of which is hereby incorporated by reference.

Figure 3:
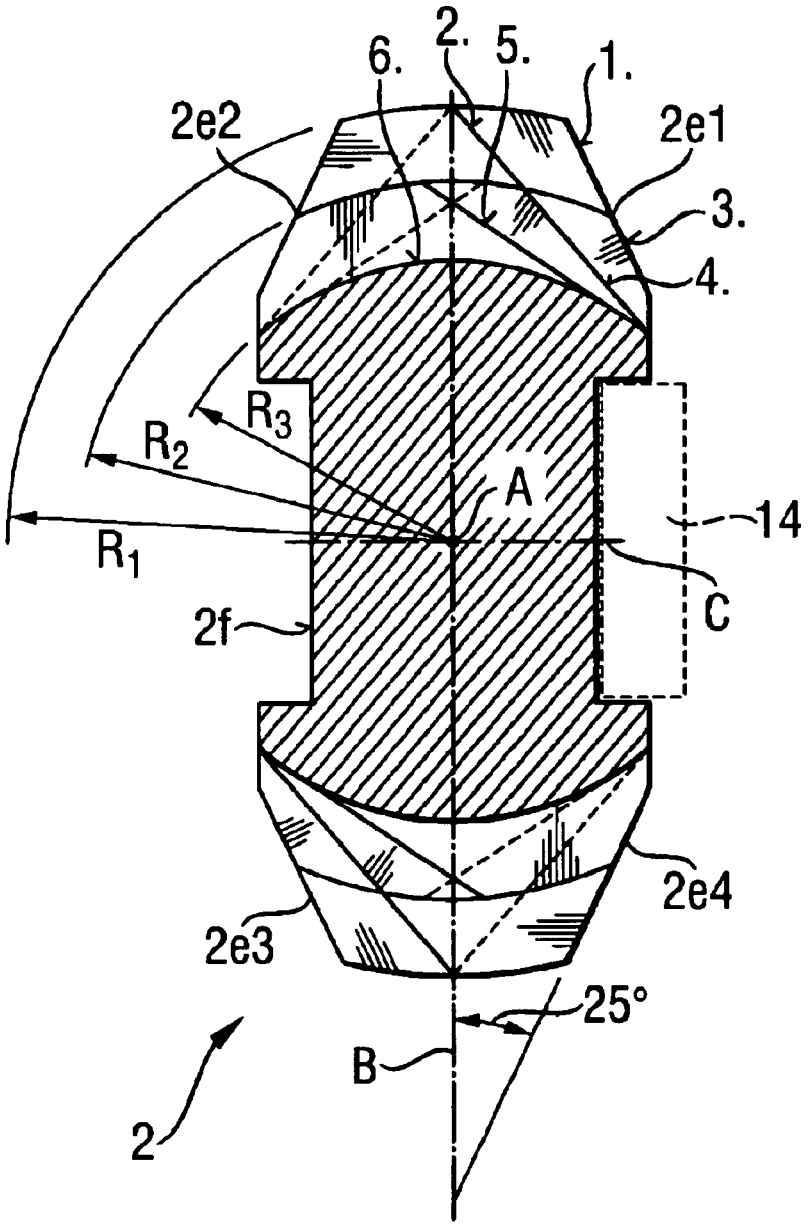
FIG. 3 shows a key according to the invention viewed along perpendicular cross-sectional plane of the key shank and the alternative combination cuts indicating the different combination values disclosed.

FIG. 3 shows a key 2 suitable for the lock of FIG. 1 and illustrating the principles according to the invention as a perpendicular cross-sectional view of the shank 2*b* at the position of one code locking disc 4. As is apparent from FIG. 3 the basic form of the cross section of the shank is a rectangle, each corner of which has a bevel surface. The bevel surfaces are designated 2*e*1, 2*e*2, 2*e*3, and 2*e*4. A key operable in only one turning direction and to be inserted in the lock in only one angular position needs a bevel surface at only one corner, for instance 2*e*1. Also the key of FIG. 3 is provided with grooves 2*f* for the guiding element 14. The reference A denotes the central longitudinal axis of the key shank 2*b*, B denotes the central axis of the rectangular cross section of the key shank 2*b* parallel to the longer sides of the rectangular cross section and C denotes the central normal for B (the axis perpendicular to both A and B). The bevel surfaces 2*e*1, 2*e*2, 2*e*3, and 2*e*4 form with advantage an angle of 25° with the central axis B.

Let us consider different alternatives for combination surfaces to be cut at the right upper corner or bevel surface 2*e*1 of the key of FIG. 3. These are formed so that the bevel surface 2*e*1 can provide selectively one of two separate combination surfaces having different combination values and the value of other combination surfaces is determined on the basis of a combination of the cutting angle of cuts to be made in the bevel surface 2*e*1 and the length of the surface to be cut. The length of the cut surfaces corresponding to different combination values is determined so that the extreme or outer ends of the cut surfaces are located on three different peripheral surfaces measured from the central axis A of the key shank. The radii of the peripheral surfaces are designated R1, R2 and R3. Thus the combination surfaces with successive combination values are obtained as follows: 1. combination is formed of the bevel surface 2*e*1 itself, more specifically its upper part; 2. combination is formed of an additional cut to be made in the bevel surface 2*e*1 and extending to the radius R1; 3. combination is formed of the lower part of the bevel surface 2*e*1 and it extends only to the radius R2, whereby, thus, the upper part of the blank must be cut away; 4. and 5. combinations are formed of successive additional cuts made in the lower part of the bevel surface 2*e*1 and they both extend to the radius R2; 6. combination comprises a cut according to the radius R3. The mutual angular pitch between successive combination surfaces is in this case 15°.

In a key according to FIG. 3 it is not necessary to have the same opening combination in both turning directions, but the combination surfaces to be cut at the adjacent bevel surfaces 2*e*1 and 2*e*2 are dependent on each other to some extent so that the value of the combination surface selected for one turning direction restricts the possible values of the combination surface which can be selected for the other turning direction. Thus, in principle the combination surfaces for the two turning directions must extend to the same radius, whereby for example if a 3. combination is selected for one turning direction a 3., 4., 5. or 6. combination must be selected for the other turning direction. This feature is illustrated by dotted lines starting from the bevel surface 2*e*2 and indicating the combination surface values to be selected for the other turning direction respectively. In addition, the combination surfaces located diametrically opposite each other with regard to the central axis A of the key shank must be identical, or the combination surface cut at the bevel surface 2*e*1 corresponds to that cut at the bevel surface 2*e*3 and similarly the combination surface cut at the bevel surface 2*e*2 corresponds to that cut at the bevel surface 2*e*4. This allows the key to be inserted in the lock in two different turning positions.

Figure 4A:
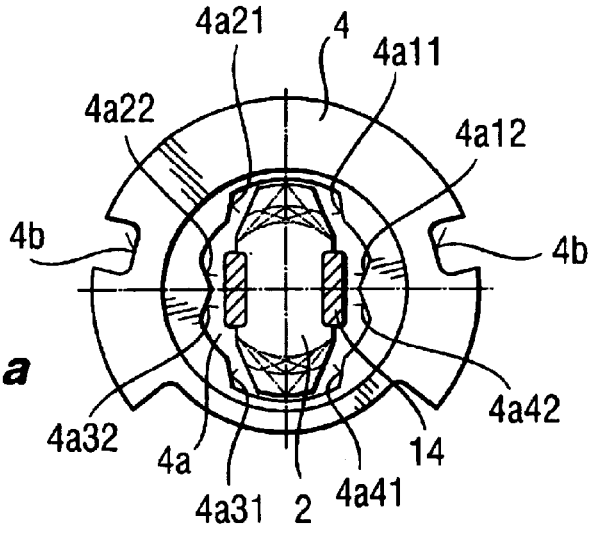
FIGS. 4*a*, 4*b* and 4*c* illustrate the cooperation between combination surfaces of different length in the key and different counter surfaces in a code locking disc of the lock which can be furnished with different combination values.
Figure 4B:
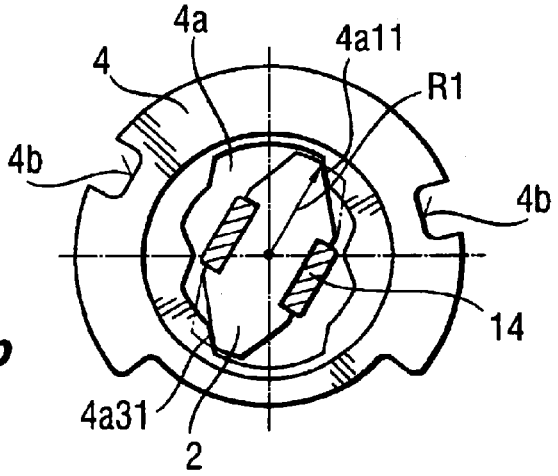
Figure 4C:
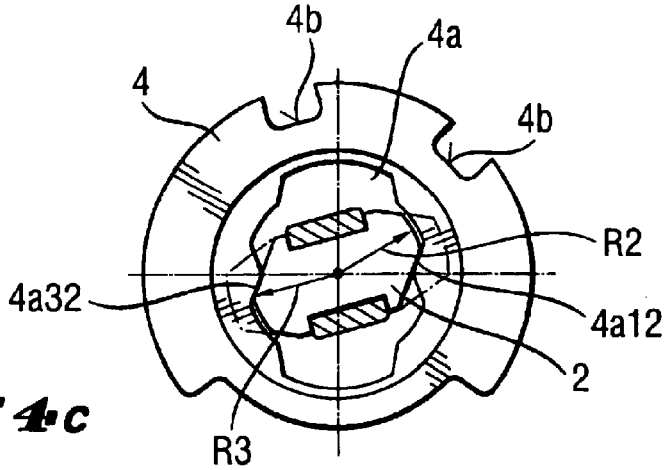
Figure 6A:
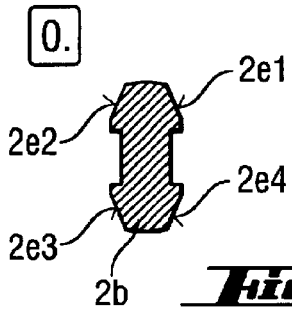
FIGS. 6*a*–6*g* show key cuts taken along perpendicular cross-sectional plane of the key shank corresponding to the locking discs shown in FIGS. 5*a*–5*g* and relating to one embodiment of the key.

FIGS. 4*a*, 4*b* and 4*c* illustrate the relationship between the combination surfaces of different length in the key and the code locking disc 4 relating to the embodiment of FIG. 1. In this case the key opening 4*a* is bounded by two counter surfaces for each bevel surface of the key, whereby the radius of the combination surface selected for that bevel surface determines which one of the counter surfaces is utilized in each case. The counter surfaces are designated as follows: 4*a*11 and 4*a*12 correspond to the combination surfaces at the bevel surface 2*e*1 in the key; 4*a*21 and 4*a*22 correspond to the combination surfaces at the bevel surface 2*e*2 in the key; 4*a*31 and 4*a*32 correspond to the combination surfaces at the bevel surface 2*e*3 in the key; and 4*a*41 and 4*a*42 correspond to the combination surfaces at the bevel surface 2*e*4 in the key. As is apparent from the figures the combination surfaces extending to a different radius R1 or R2 act correspondingly on a different counter surface in the key opening and in addition the combination surface having the radius R3 (Combination 6.) does not turn the code locking disc at all.

FIGS. 5*a*–5*g* show the position of the peripheral notch in the locking disc in each case corresponding to the different combination values and FIGS. 6*a*–6*g* show the key cuts or combination surfaces corresponding to the locking discs shown in FIGS. 5*a*–5*g* in a cross-sectional plane of the key shank in accordance with one embodiment of the key. The combination surfaces relating to the bevel surface 2*e*1 of the key or to be cut thereto correspond to the peripheral notches 4*b*1 and the combination surfaces relating to the bevel surface 2*e*2 of the key or to be cut thereto correspond to the peripheral notches 4*b*2 respectively. As described above the combination surfaces to be cut in the bevel surface 2*e*2 can be afforded different alternative values depending on the combination value of the bevel surface 2*e*1, and one of these combination surfaces is selected here as an example.

Figure 5A:
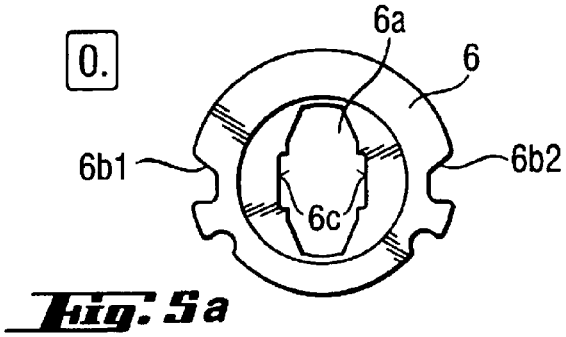
FIGS. 5*a*–5*g* show different alternatives of locking discs corresponding to different combination values.
Figure 5B:
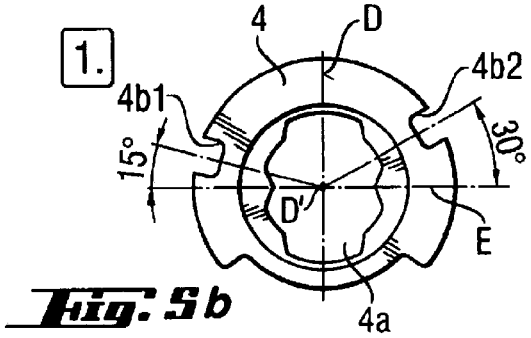
Figure 6B:
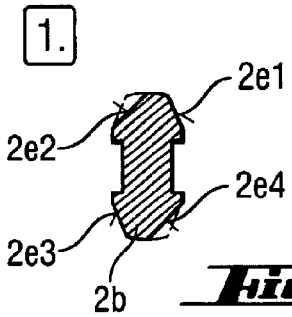
Figure 5C:
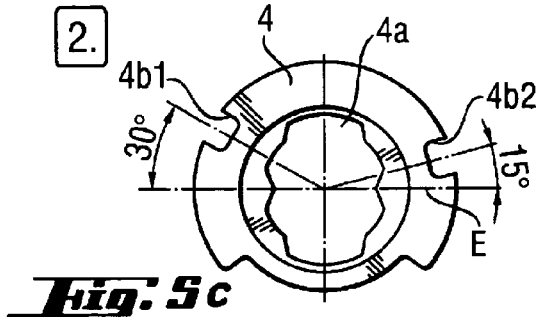
Figure 6C:
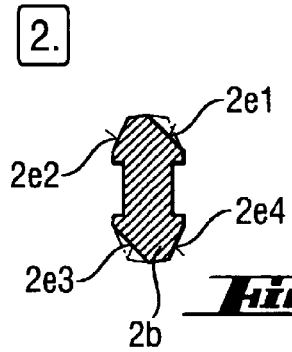
Figure 5D:
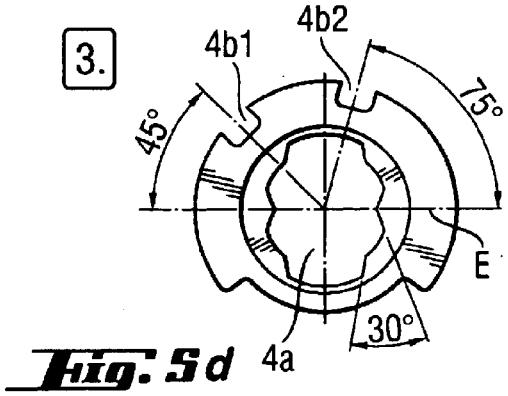
Figure 6D:
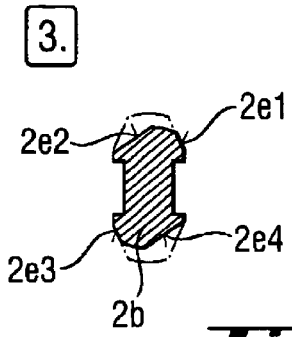
Figure 5E:
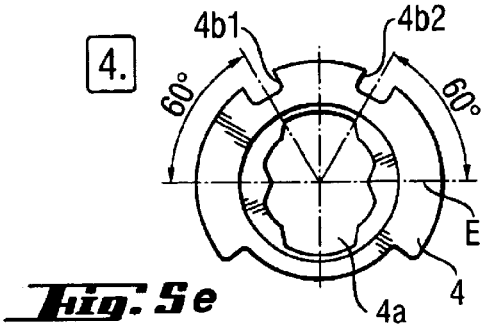
Figure 6E:
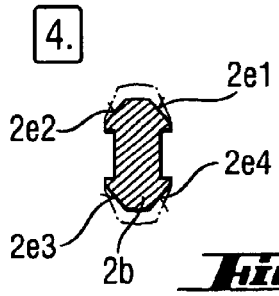
Figure 5F:
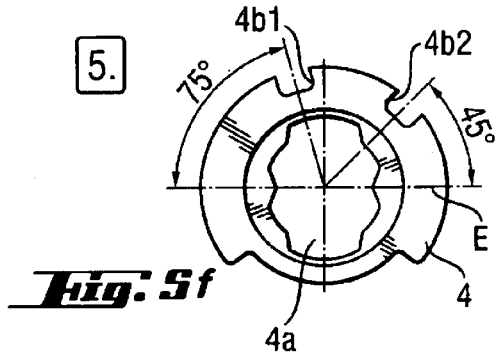
Figure 6F:
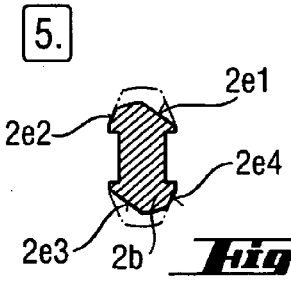
Figure 5G:
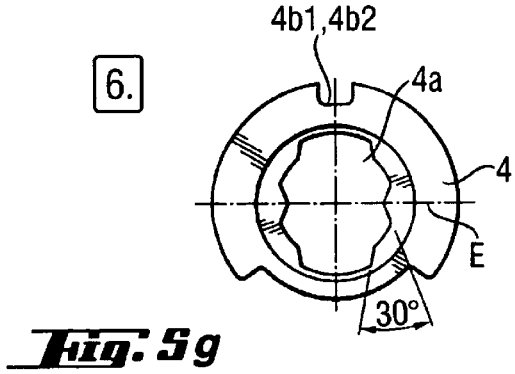
Figure 6G:
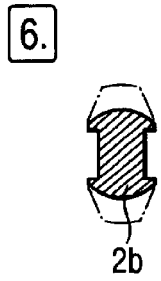

The reference D in FIG. 5*b* denotes the central axis of the key opening 4*a* in the locking disc 4, reference D' denotes the turning axis of the locking disc 4, which coincides with the turning axis A of the key when the key is inserted in the lock, and E denotes central normal for D (the axis perpendicular to the axes D and D'). These references are provided in order to illustrate the mutual location and symmetrical position of the different counter surfaces 4*a*11–4*a*42 in the code locking disc 4 (cf. FIG. 4*a*).

It can also be observed from FIGS. 5 and 6 that a combination surface in the key corresponding to a smaller combination value turns the code locking disc 4 to a greater extent correspondingly. In addition it can be observed that the key opening 6*a* of the lifting 0-locking disc 6 according to FIG. 5*a* is smaller than that of the other locking discs or code locking discs 4 so that it corresponds exactly to the profile of the key shank 2*b*. Thus, the locking disc 6 can be utilized expressly for defining the profile of a key compatible with the lock. In addition the key opening 6*a* of the locking disc 6 includes grooves 6*c* for the guiding element 14 (cf. FIGS. 1 and 5*a*). Hence for possible new profiles varying from the basic profile of the key the areas between the bevel surfaces 2*e*1 and 2*e*4 and correspondingly 2*e*2 and 2*e*3 may be utilized (cf. FIGS. 3 and 12) and when desired also the design of the guiding element 14 may be made use of. The new key profiles hereby obtained are unique due to the new arrangement relating to the combination surfaces in the lock, for which reason the key of an old lock cannot be utilized in a lock according to the invention, even if the key could be inserted in the lock as such.

Since the key opening 6*a* in the 0-locking disc 6 is smaller than the key opening 4*a* in the code locking discs 4, the key can be turned through a small angle, about 15°, after inserting it in the lock before a combination surface of the key 2 engages the first counter surface in the key opening 4*a*. This increases the resistance of the lock to picking. The arrangement according to the invention provides further that the mutual angular pitch between the combination values can be smaller than normal without compromising the reliability of operation of the lock mechanism. Hereby, when desired, it is possible to provide seven different combination values instead of the conventional six different ones. This requires only a correspondingly denser mutual pitch for the peripheral notches in the code locking discs 4. Hereby a substantial number of different opening combinations can further be provided which together with new different key profiles provide substantially more potential for different and even very extensive locking applications.

Figure 7:
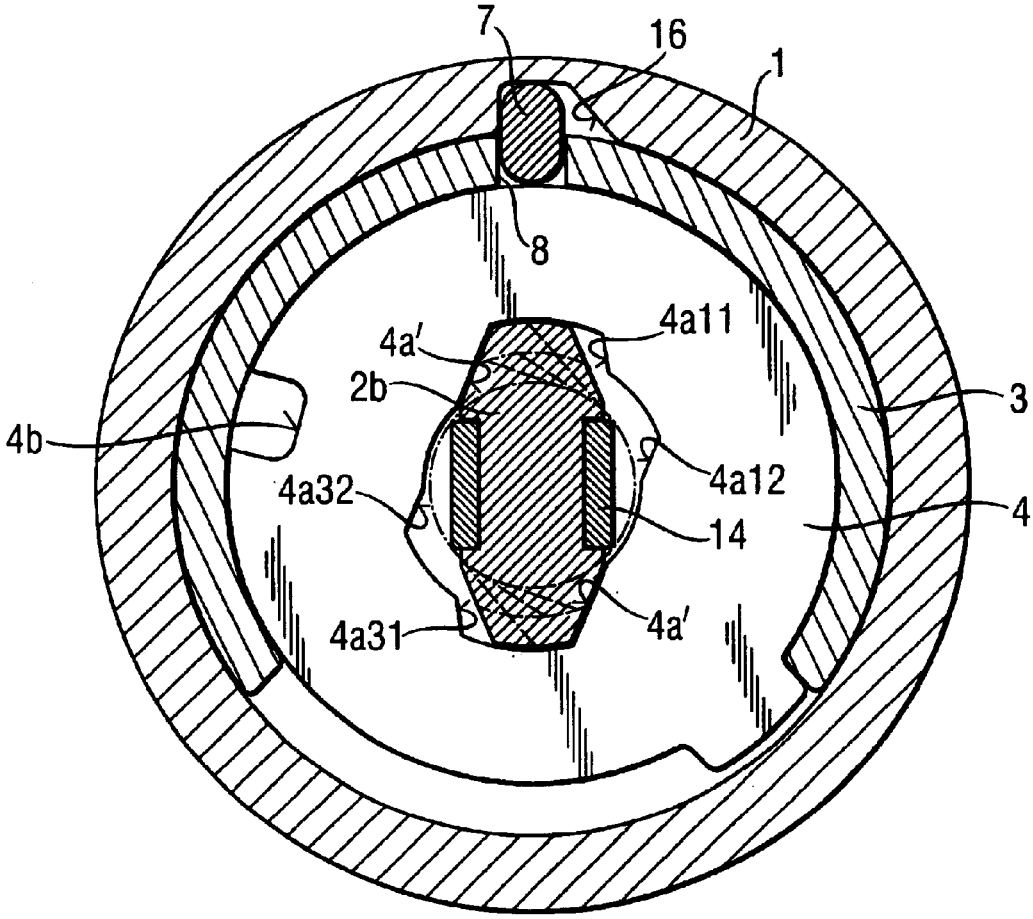
FIG. 7 shows an embodiment of the invention operable in one rotating direction as a sectional view taken at the position of a code locking disc of the lock.

FIG. 7 shows an embodiment of the invention operable in one turning direction. In this case it is sufficient that the key opening 4*a* of the code locking discs 4 has two counter surfaces 4*a*11 and 4*a*12 for the key. Additionally surfaces 4*a*31 and 4*a*32 corresponding to the surfaces 4*a*11 and 4*a*12 and arranged diametrically with regard to the axis A of the key are needed, in case it is desired that the key can be inserted in the lock in two different angular positions. Hence, the key openings 4*a* in the locking discs 4 can in this case in any event be provided with counter surfaces 4*a*', which the key can directly influence for returning the locking discs to their initial locking position, in which the key can be inserted in the key channel. This corresponds to the operation of a conventional cylinder lock provided with rotatable locking discs, whereby no separate return bars or the like members are needed. As is apparent from FIG. 7 the counter surfaces 4*a*11 can with advantage form a common surface with the counter surfaces 4*a*12 and 4*a*32 provided for the combination surfaces of the key. The counter surfaces 4*a*′ can naturally be designed also in a different way, but the disclosed embodiment has the advantage that when desired the same key profile can be utilized in it as in the bidirectionally operable locks. An alternative way to return the code locking discs is also in this case utilization of a return bar, whereby both the bidirectionally operable and unidirectionally operable locks can be provided with similar key profiles and in addition similar locking discs.

Figure 11C:
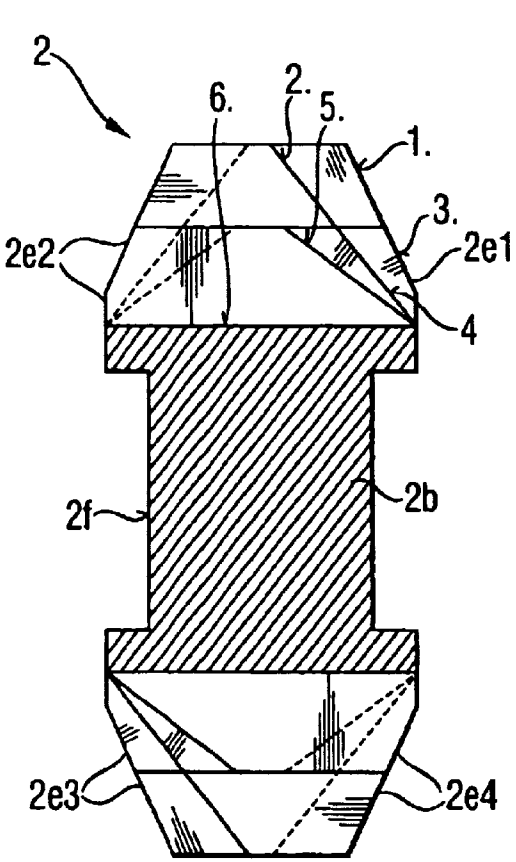
FIGS. 11*a*, 11*b* and 11*c* show three alternatives of a key according to the invention in a cross-sectional plane of the shank and the alternative combination cuts indicating different combination values disclosed.
Figure 11B:
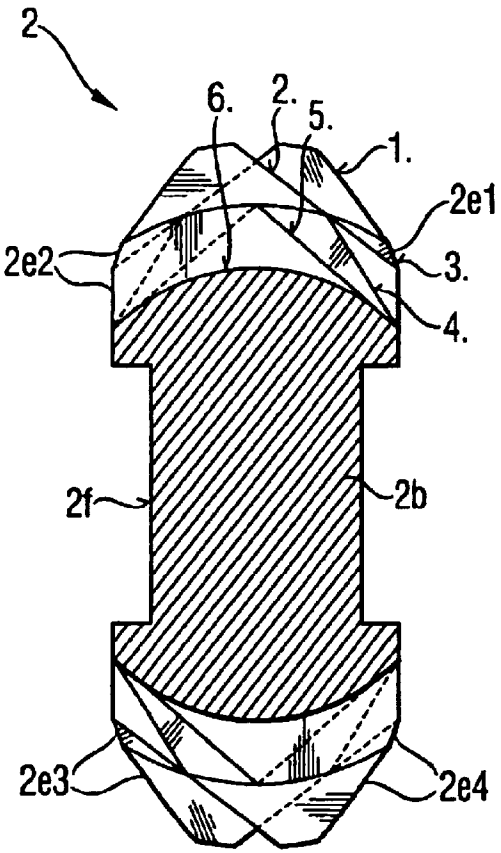
Figure 11A:
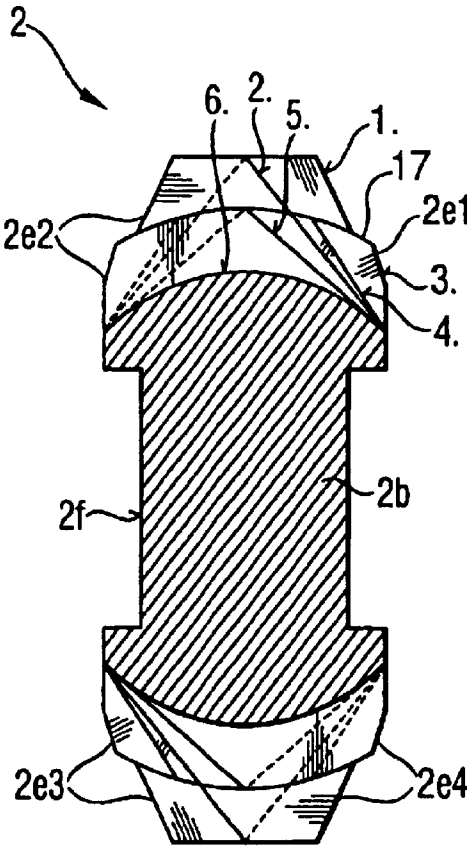

FIGS. 11*a*, 11*b* and 11*c* show three alternative designs of a shank 2*b* for a key blank and a key to be cut therefrom with alternative combination cuts of the key corresponding to different combination values. In the case of FIGS. 11*a* and 11*b* each bevel surface 2*e*1–2*e*4 is divided into two parts so that in the embodiment of FIG. 11*a* the shorter combination surfaces e.g. the 3. and 4. combination surfaces, are not aligned with the longer combination surfaces (the 1. and 2. combination surfaces respectively) but are separated from each other by a step 17, as shown in FIG. 11*a* between the 1. and 3. combination surfaces. In the case of FIG. 11*b* the shorter combination surfaces are inclined at a small angle to the longer combination surfaces, as shown particularly for the 2. and 4. combination surfaces. As a consequence in both these embodiments the angular pitch between cut surfaces corresponding to successive combination values of the key are partly different, but the cooperation between them and the corresponding surfaces in the locking discs 4 (cf. for instance FIG. 4: 4*a*11, 4*a*12 etc.) can be arranged such that the mutual angular pitch between the corresponding peripheral notches in the code locking discs 4 remains 15°, whereby the operation of the lock mechanism corresponds to the one described for the embodiment of FIG. 1. Regardless of the design of the central area in the key, i.e. the grooves 2*f*, and regardless of the combinations, a key in accordance with the arrangement of FIG. 11*a* will not operate a lock designed for a key in accordance with FIG. 11*b* and vice versa, and a key in accordance with the arrangement of FIG. 11*a* or FIG. 11*b* will not operate a lock designed for a key in accordance with FIG. 3 and vice versa.

As is specifically apparent from FIG. 11*c*, but partly also from FIGS. 11*a* and 11*b*, the peripheral surfaces of the key shank 2*b* relating to different combination values need not form arcs of circles or other curved surfaces but they may also be planes, which is simpler from the viewpoint of manufacturing technique. In the version of FIG. 11*c* all the peripheral surfaces are planes. In the case of FIG. 11*a* only the outermost peripheral surface is a plane and in the case of FIG. 11*b* the outermost peripheral surface correspondingly comprises two distinct planes at the same distance from the central axis of the key blank.

Figure 12:
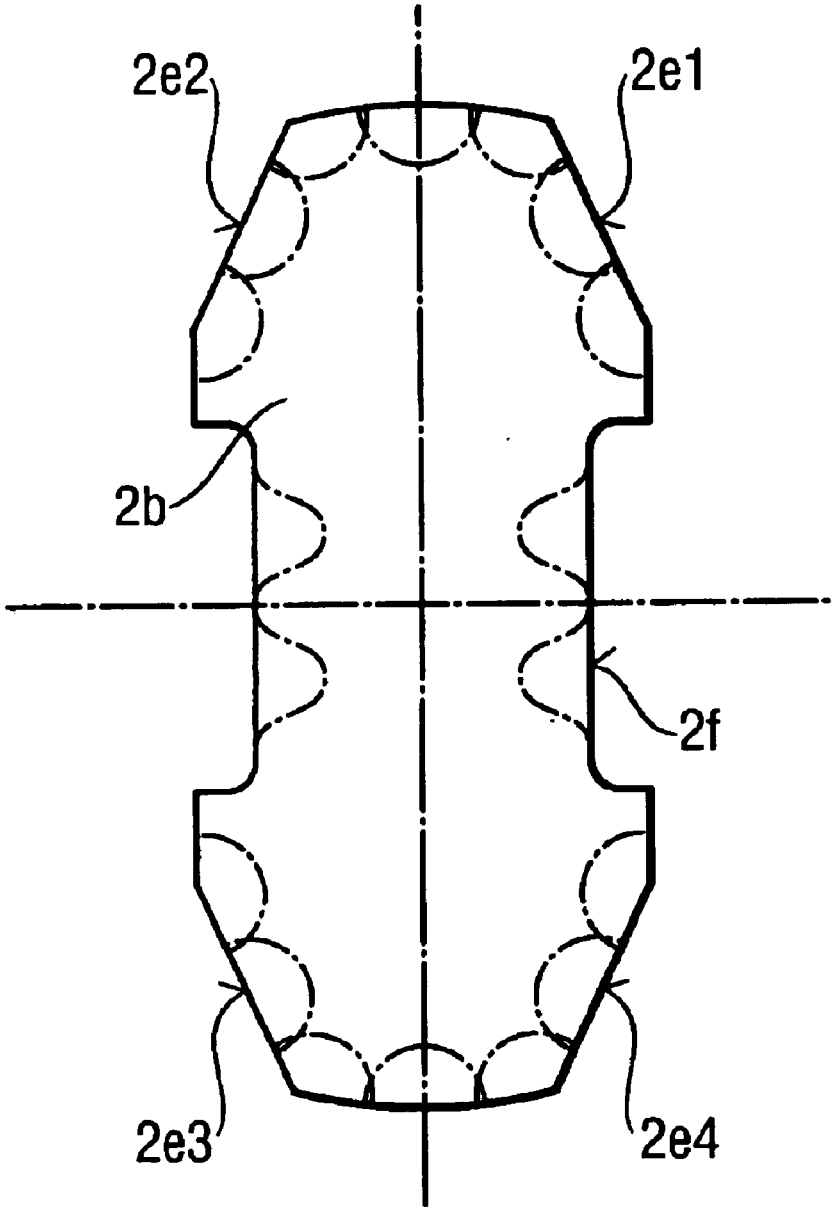
FIG. 12 illustrates some alternative profiles to be provided for a key blank according to the invention and for a key to be made of it.

FIG. 12 shows the form of the shank 2*b* of the key blank as a perpendicular cross-sectional plane taken at the position of the inner lifting 0-locking disc. Some possible profile groove alternatives are drawn in dotted lines in FIG. 12 as a matter of example. Naturally the form and size of the profile grooves may additionally be changed when desired. However, the outer or first lifting 0-locking disc (or corresponding member determining the profile of the key) cannot be utilized to specify grooves, which would extend over the length of the key inward of the outer 0-locking disc, because such grooves would affect the operation of the lock mechanism. Hence by means of the 0-locking disc or corresponding member only outer basic forms for the combination surface area of key blanks can be determined. In addition, naturally, the parts of key blanks located between the combination surface areas are also in this case available for providing different key profile grooves. These grooves can be arranged independent of the guiding element 14 and the guiding surface 2*f* of the key and in addition also the form of the guiding element 14 may be varied when desired as is for example apparent from FIG. 1 and on the other hand FIGS. 4, 7–10.

The invention is not limited to the embodiments shown, but several modifications are feasible within the scope of the attached claims.

What is claimed is:

1. A cylinder lock and key combination comprising:

a lock body, a turnable lock cylinder located inside the lock body and having an axial slot, a set of code locking discs located inside the lock cylinder, each locking disc having at least one peripheral notch and a key opening and being turnable in the lock body in a first turning direction about a turning axis by application of turning force to a counter surface bounding the key opening, each locking disc having an initial position, such that when all the locking discs are in their respective initial positions the key openings form a key passage, and an opening position in which its peripheral notch is at the position of the axial slot in the lock cylinder, such that when all the locking discs are in their respective opening positions the peripheral notches form a uniform channel at the position of the axial slot, the key openings of at least first and second code locking discs each being bounded by at least first and second discrete counter surfaces such that the first code locking disc can be turned in said first turning direction by application of turning force to any one of said discrete counter surfaces of the first code locking disc and the second code locking disc can be turned in said first turning direction by application of turning force to any one of said discrete counter surfaces of the second code locking disc, a locking bar having a locking position in which it prevents turning of the cylinder relative to the lock body and a releasing position in which it is received in the channel formed by the peripheral notches of the locking discs and releases the cylinder for turning relative to the lock body, and a key insertable in the lock when the locking discs are at the initial position, the key having a set of combination surfaces corresponding respectively to the locking discs, for engaging a counter surface of each locking disc and applying turning force thereto when the key is inserted in the lock and is turned in the first turning direction, so that the locking discs are turned in the first turning direction to their respective opening positions, and wherein the combination surface corresponding to said first code locking disc is provided with a first of at least two combination values and the combination surface corresponding to said second code locking disc is provided with a second of said at least two combination values, and the first and second combination values are such that upon inserting the key in the key passage and turning the key through a first turning angle in the first turning direction, the combination surface corresponding to the first code locking disc engages the first counter surface bounding the key opening of the first code locking disc and the combination surface corresponding to the second code locking disc clears the first counter surface bounding the key opening of the second code locking disc, and upon turning of the key in the first turning direction through a further turning angle the combination surface corresponding to the second code locking disc engages the second counter surface bounding the key opening of the second code locking disc.

2. A cylinder lock and key combination according to claim 1, wherein the key opening of said first locking disc has first and second discrete counter surfaces for engagement selectively by the combination surface corresponding to said first locking disc for turning said first locking disc in the first turning direction, and the first and second discrete counter surfaces are arranged at a distance from each other and are located at different respective angles with regard to a central axis (D) of the key opening of said first locking disc.

3. A cylinder lock and key combination according to claim 2, wherein the first and second discrete counter surfaces are inclined at an angle of about 30°.

4. A cylinder lock and key combination according to claim 1, wherein the second counter surface bounding the key opening of the first code locking disc extends substantially to the central normal (E) of the central axis (D) of the key opening.

5. A cylinder lock and key combination according to claim 1, wherein the key openings of the code locking discs are substantially identical and are formed so that the combination surfaces of the key engage the respective counter surfaces of the corresponding locking discs only after the key has been turned through a selected angle from the initial insertion position of the key.

6. A cylinder lock and key combination according to claim 5, wherein said selected angle is about 15°.

7. A cylinder lock and key combination according to claim 1, further comprising at least one lifting 0-locking disc having a key opening smaller than the key openings of the code locking discs.

8. A cylinder lock and key combination according to claim 1, wherein the lock is operable in only one turning direction and the key opening of said first locking disc is bounded by a return surface which cooperates with the key to return said first locking disc to a locking position when the key is turned in a second turning direction, opposite said first turning direction, the return surface being opposite to the counter surfaces with regard to the central axis of said first locking disc.

9. A cylinder lock and key combination according to claim 8, wherein said return surface is aligned with one of the counter surfaces of said first locking disc.

10. A cylinder lock and key combination according to claim 1, wherein the lock is operable in two turning directions and each locking disc is turnable in a second turning direction, opposite the first turning direction, by application of turning force to a counter surface bounding the key opening, the key has a second set of combination surfaces for engaging a counter surface of each locking disc when the key is turned in the second turning direction, the key opening of said first locking disc is bounded by third and fourth discrete counter surfaces for engagement selectively by a combination surface of the second set, and the combination surface of the second set corresponding to said first locking disc is provided selectively with one of at least two combination values.

11. A cylinder lock and key combination according to claim 10, wherein said first locking disc has fifth and sixth counter surfaces and seventh and eighth counter surfaces, the counter surfaces serving for the same turning direction being located in pairs diametrically on either side of the turning axis (D') of said first locking disc.

12. A cylinder lock and key combination according to claim 1, wherein said two discrete counter surfaces bounding the key opening of the first code locking disc are within a common quadrant of the first code locking disc.

13. A cylinder lock and key combination according to claim 1, wherein the key includes an elongate shank having a longitudinal axis and the basic form of the shank in the perpendicular cross-sectional plane of the shank, exclusive of any possible profile grooves or corresponding grooves extending longitudinally of the shank of the key, is substantially rectangular except for at least one bevel surface inclined at an acute angle to a plane containing the longitudinal axis of the key shank and a central axis of the rectangular cross-sectional form of the key shank and the set of code locking discs includes a third locking disc between the first and second code locking discs and the combination surface corresponding to the third locking disc has the same length and inclination as said one bevel surface.

14. A key blank of a key for operating a disc cylinder lock comprising:

a lock body, a turnable lock cylinder located inside the lock body and having an axial slot, a set of code locking discs located inside the lock cylinder, each locking disc having at least one peripheral notch and a key opening and being turnable in the lock body in a first turning direction about a turning axis by application of turning force to a counter surface bounding the key opening, each locking disc having an initial position, such that when all the locking discs are in their respective initial positions the key openings form a key passage, and an opening position in which its peripheral notch is at the position of the axial slot in the lock cylinder, such that when all the locking discs are in their respective opening positions the peripheral notches form a uniform channel at the position of the axial slot, the key openings of at least first and second code locking discs each being bounded by at least first and second discrete counter surfaces such that the first code locking disc can be turned in said first turning direction by application of turning force to any one of said discrete counter surfaces of the first code locking disc and the second code locking disc can be turned in said first turning direction by application of turning force to any one of said discrete counter surfaces of the second code locking disc, and a locking bar having a locking position in which it prevents turning of the cylinder relative to the lock body and a releasing position in which it is received in the channel formed by the peripheral notches of the locking discs and releases the cylinder for turning relative to the lock body, wherein the key blank has rotational symmetry of order 2 and includes an elongate shank having a longitudinal axis and the basic form of the shank of the key blank in the perpendicular cross-sectional plane of the shank, exclusive of any possible profile grooves or corresponding grooves extending longitudinally of the shank of the key blank, is substantially symmetrical with respect to a plane containing said longitudinal axis and is substantially rectangular except for bevel surfaces for providing combination surfaces at respective corners of the substantially rectangular cross-sectional form, said bevel surfaces being inclined to the plane of symmetry of the shank and comprising a first bevel surface at a first corner of the substantially rectangular cross-sectional form for providing combination surfaces for engaging counter surfaces of the locking discs for turning the locking discs in said first turning direction and a second bevel surface at a second corner of the substantially rectangular cross-sectional form for providing combination surfaces for engaging counter surfaces of the locking discs for turning the locking discs in a second turning direction, opposite said first turning direction.

15. A key blank according to claim 14, wherein the rectangular cross section of the shank has a longer side and a shorter side and the shank has a central cross-sectional plane parallel to the longer side of the rectangular cross section and said bevel surface is inclined to said central cross-sectional plane at an angle of 20°–30°.

16. A key blank according to claim 14, wherein said first bevel surface is divided into two parts extending mutually in different directions and each of which forms one combination surface.

17. A key blank according to claim 14, wherein said first bevel surface is divided into two at least substantially parallel parts separated from each other by a step and each forming one combination surface.

18. A key blank according to claim 14, wherein the shank of the key blank is symmetrical with regard to the central axis of the shank.

19. A key blank according to claim 14, wherein the rectangular cross section of the shank has a longer side and a shorter side, the shank has a central axis (B) parallel to the longer side of the rectangular cross section, and the shank of the key blank is symmetrical with regard to both the central axis (B) and its central normal (C).

20. A key blank according to claim 14, wherein when the key blank is intended for a lock operable only in one turning direction the bevel surface of every second corner of the shank is arranged to operate as a return surface for the locking discs.

21. A key for operating a disc cylinder lock comprising:

a lock body, a turnable lock cylinder located inside the lock body and having an axial slot, a set of code locking discs located inside the lock cylinder, each locking disc having at least one peripheral notch and a key opening and being turnable in the lock body in a first turning direction about a turning axis by application of turning force to a counter surface bounding the key opening, each locking disc having an initial position, such that when all the locking discs are in their respective initial positions the key openings form a key passage, and an opening position in which its peripheral notch is at the position of the axial slot in the lock cylinder, such that when all the locking discs are in their respective opening positions the peripheral notches form a uniform channel at the position of the axial slot, the key openings of at least first and second code locking discs each being bounded by at least first and second discrete counter surfaces such that the first code locking disc can be turned in said first turning direction by application of turning force to any one of said discrete counter surfaces of the first code locking disc and the second code locking disc can be turned in said first turning direction by application of turning force to any one of said discrete counter surfaces of the second code locking disc, and a locking bar having a locking position in which it prevents turning of the cylinder relative to the lock body and a releasing position in which it is received in the channel formed by the peripheral notches of the locking discs and releases the cylinder for turning relative to the lock body, and wherein the key includes an elongate shank and an elongate bit having a common longitudinal axis, the basic form of the shank and bit in the perpendicular cross-sectional plane of the shank and bit, exclusive of any possible profile grooves or corresponding grooves extending longitudinally of the shank and bit of the key, is substantially rectangular except for at least one bevel surface, over the length of the shank said one bevel surface is inclined at an acute angle to a plane containing said common longitudinal axis and a central axis of the rectangular cross-sectional form of the key shank, in the bit said one bevel surface provides at least first and second combination surfaces corresponding to the first and second code locking discs respectively and having first and second combination values respectively, and the first combination surface differs from the second combination surface with respect to the combination of the angle of the cut and the length of the cut in said one bevel surface.

22. A key according to claim 21, wherein the angular pitch between cuts corresponding to successive combination values is about 15°.

23. A key according to claim 21, wherein the length of the cut surfaces corresponding to different combination values is determined so that the extreme ends thereof are located at most on three different peripheral surfaces measured from the central axis (A) of the shank of the key.

24. A key according to claim 23, wherein the extreme ends of the cut surfaces providing for turning movement for the locking discs and corresponding to different combination values are located on two different peripheral surfaces measured from the central axis (A) of the shank of the key.

25. A key according to claim 23, wherein the combination surfaces of the key extending to the same peripheral surface are located mutually with equal pitch.

26. A key according to claim 20, wherein the combination cuts diametrically opposite each other with regard to the central axis (A) of the shank of the key are symmetrical.

27. A key according to claim 20, wherein the key has four cut surfaces for each code locking disc and the combination cuts located diametrically opposite each other with regard to the central axis (A) of the shank of the key are identical.

28. A key according to claim 21, wherein the basic form of the shank in the perpendicular cross-sectional plane of the shank, exclusive of any possible profile grooves or corresponding grooves extending longitudinally of the shank of the key, is substantially rectangular except for at least two bevel surfaces for providing combination surfaces corresponding to the code locking discs, said bevel surfaces comprising said one bevel surface, for providing combination surfaces for engaging counter surfaces of the locking discs for turning the locking discs in said first turning direction, and a second bevel surface for providing combination surfaces for engaging counter surfaces of the locking discs for turning the locking discs in a second turning direction, opposite said first turning direction.

29. A key according to claim 21, wherein the bit includes a length segment between the first and second combination surfaces, said length segment of the bit is substantially symmetrical with respect to a plane containing said longitudinal axis, and said one bevel surface is inclined to said plane.

30. A key according to claim 21, wherein the key shank has rotational symmetry of order 2.

31. A key according to claim 21, for operating a disc cylinder lock in which the set of locking discs includes a third locking disc, and wherein said one bevel surface provides a third combination surface for engaging the third locking disc and the third combination surface has the same length and inclination as said one bevel surface.

32. A cylinder lock and key combination comprising:

a lock body, a turnable lock cylinder located inside the lock body and having an axial slot, a set of code locking discs located inside the lock cylinder, each locking disc having at least one peripheral notch and a key opening and being turnable in the lock body in a first turning direction by application of turning force to a counter surface bounding the key opening, each locking disc being at an initial position and being turnable in the first direction to an opening position in which its peripheral notch is at the position of the axial slot in the lock cylinder, such that when all the locking discs are in their respective opening positions the peripheral notches form a uniform channel at the position of the axial slot, the key openings of at least first and second code locking discs each being bounded by at least first and second discrete counter surfaces such that the first code locking disc can be turned in said first turning direction by application of turning force to any one of said discrete counter surfaces of the first code locking disc and the second code locking disc can be turned in said first turning direction by application of turning force to any one of said discrete counter surfaces of the second code locking disc, a locking bar having a locking position in which it prevents turning of the cylinder relative to the lock body and a releasing position in which it is received in the channel formed by the peripheral notches of the locking discs and releases the cylinder for turning relative to the lock body, and a key in the lock, the key having a set of combination surfaces corresponding respectively to the locking discs, for engaging a counter surface of each locking disc and applying turning force thereto when the key is turned in the first turning direction, and wherein the combination surface corresponding to said first code locking disc is provided with a first of at least two combination values and the combination surface corresponding to said second code locking disc is provided with a second of said at least two combination values, and the first and second combination values are such that upon turning the key through a first turning angle in the first turning direction, the combination surface corresponding to the first code locking disc engages the first counter surface bounding the key opening of the first code locking disc and the combination surface corresponding to the second code locking disc clears the first counter surface bounding the key opening of the second code locking disc, and upon turning of the key in the first turning direction through a further turning angle the combination surface corresponding to the second code locking disc engages the second counter surface bounding the key opening of the second code locking disc.

* * * * *

UNITED STATES PATENT AND TRADEMARK OFFICE

CERTIFICATE OF CORRECTION

PATENT NO. : 6,799,447 B2
DATED : October 5, 2004
INVENTOR(S) : Pekka Mielonen and Seppo Kiiski It is certified that error appears in the above-identified patent and that said Letters Patent is hereby corrected as shown below:

Column 15,
Lines 42 and 45, "20" should be deleted and replaced with -- 21 --.

Signed and Sealed this

Second Day of August, 2005

JON W. DUDAS
*Director of the United States Patent and Trademark Office*